US007743707B1

(12) United States Patent
Melin et al.

(10) Patent No.: US 7,743,707 B1
(45) Date of Patent: Jun. 29, 2010

(54) FRAGMENTATION WARHEAD WITH SELECTABLE RADIUS OF EFFECTS

(75) Inventors: Roger W. Melin, Arlington, TX (US); Edward W. Sheridan, Orlando, FL (US)

(73) Assignee: Lockheed Martin Corporation, Grand Prairie, TX (US)

( * ) Notice: Subject to any disclaimer, the term of this patent is extended or adjusted under 35 U.S.C. 154(b) by 347 days.

(21) Appl. No.: 11/971,162

(22) Filed: Jan. 8, 2008

Related U.S. Application Data

(60) Provisional application No. 60/884,035, filed on Jan. 9, 2007.

(51) Int. Cl.
*F42B 12/22* (2006.01)

(52) U.S. Cl. ..... 102/493; 102/497; 102/506

(58) Field of Classification Search ..... 102/491–497, 102/473, 501, 506
See application file for complete search history.

(56) References Cited

U.S. PATENT DOCUMENTS

| | | | | | |
|---|---|---|---|---|---|
| 3,447,463 | A * | 6/1969 | Lavine | 102/492 |
| 3,853,059 | A * | 12/1974 | Moe | 102/493 |
| 3,853,060 | A * | 12/1974 | Weeding | 102/495 |
| 3,877,376 | A * | 4/1975 | Kupelian | 102/492 |
| 3,970,005 | A * | 7/1976 | Rothman | 102/492 |
| H238 | H * | 3/1987 | Adams | 102/493 |
| 4,745,864 | A * | 5/1988 | Craddock | 102/491 |
| H1048 | H * | 5/1992 | Wilson et al. | 102/496 |
| 5,131,329 | A * | 7/1992 | Lips et al. | 102/364 |
| 5,159,152 | A * | 10/1992 | Pujols | 102/306 |
| 5,163,166 | A * | 11/1992 | Adler et al. | 102/492 |
| 5,690,867 | A * | 11/1997 | Nouguez et al. | 264/3.1 |
| 5,852,256 | A * | 12/1998 | Hornig | 102/473 |
| 7,194,961 | B1 * | 3/2007 | Nechitailo | 102/518 |
| 7,383,775 | B1 * | 6/2008 | Mock et al. | 102/363 |
| 7,494,705 | B1 * | 2/2009 | Sheridan et al. | 428/336 |
| 2004/0089185 | A1 * | 5/2004 | Ronn et al. | 102/494 |

* cited by examiner

*Primary Examiner*—Michelle Clement
(74) *Attorney, Agent, or Firm*—Davis Patent Services, LLC

(57) ABSTRACT

An explosive structure of the fragmentation type includes an outer casing comprising an energy dense explosive material and having an inner surface defining a chamber and means for propagating shock waves across the inner surface from a selected one of at least first and second detonation points within the casing. The explosive structure further includes first means for directing shock waves, propagated from the first detonation point, against at least a selected portion of the inner surface in a first pattern for scoring and weakening the casing along first, segment-defining lines and second means for directing shock waves, propagated from the second detonation point, against the selected portion of the inner surface in a second pattern for scoring and weakening the casing along second, segment-defining lines, the segments of the second pattern being larger than the segments of the first pattern. The explosive structure further includes means for fragmenting the casing along the resulting, segment-defining lines scored in the casing.

23 Claims, 3 Drawing Sheets

FRAGMENTATION WARHEAD WITH SELECTABLE RADIUS OF EFFECTS

CROSS-REFERENCE TO RELATED APPLICATIONS

This application claims the benefit of U.S. Provisional Application No. 60/884,035; filed 9 Jan. 2007; and entitled "Explosive, Fragmentation Structure with Selectable Radius of Effects," which is hereby expressly incorporated by reference for all purposes.

BACKGROUND

1. Field of the Invention

This invention relates to an explosive, fragmentation structure and, more particularly, to an explosive, fragmentation structure having means for selectively controlling the radius of effects upon detonation of the fragmentation structure.

2. Description of Related Art

Fragmentation structures, such as fragmentation warheads, mines, etc., are employed by the military against a wide variety of targets where dispersion of fragments over a target area is required. A problem which arises in their use is that fragmentation warheads suitable for use against personnel are generally not suitable for use against "hard" targets such as armored vehicles and emplacements, where fragments of relatively greater size and mass are required. Military units have therefore been required to maintain supplies of several types of fragmentation warheads, each type adapted for use against a particular type of target. This results in an increased burden of logistics and supply and is, of course, highly undesirable. In the past, it has been attempted to minimize this problem by constructing warheads having two sections, one section being adapted to disperse fragments of one size and the other being adapted to disperse fragments of another size. In this manner, a single warhead may be utilized against a variety of targets. Such a construction, however, is inefficient in that, in each case, portions of the warhead not designed for the particular application are largely ineffective; furthermore, in order to produce a given amount of destructive force, a warhead of larger dimensions is necessary than would be the case for one designed for the specific application.

To address these problems, an explosive, fragmentation structure has been developed that includes means for selectively controlling fragment size and configuration. The structure includes an outer casing having an inner surface defining a chamber and further includes means for propagating shock waves across the inner surface from a selected one of two detonation points with the chamber. Means are provided for directing shock waves, propagated from the first detonation point, against the surface in a first pattern of segment-defining lines and for directing shock waves, propagated from the second detonation point, against the surface in a second pattern of lines which define segments larger than those of the first pattern. Thus, either larger segments or smaller segments can be selected depending upon the target.

Such explosive fragmentation structures, however, do not address "radius of effects" considerations. Generally, the term "radius of effects" means the distance from the detonated structure at which significant damage occurs. Conventional, explosive, fragmentation structures do not exhibit controlled radius of effects. Thus, such conventional, explosive, fragmentation structures may cause significant damage at radii greater than desired, causing undesirable collateral damage to personnel and/or equipment.

There are many designs of explosive, fragmentation structures well known in the art, however, considerable shortcomings remain.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

Figure 1:
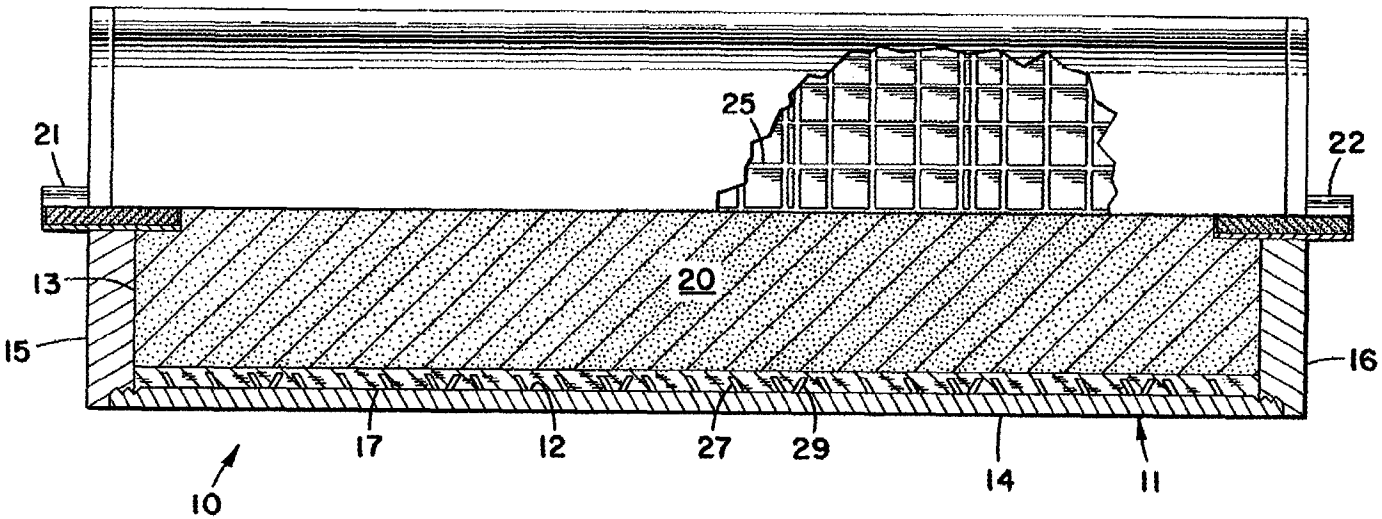
FIG. 1 is a longitudinal, partially sectional, plan view of one embodiment of a fragmentation warhead constructed according to the present invention and having portions cut away for greater clarity.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an explosive, fragmentation structure having means for selectively controlling fragment size, configuration, and radius of effects. The structure includes an outer casing comprising an energy dense explosive and having an inner surface defining a chamber. The fragmentation structure further includes means for propagating shock waves across the inner surface from a selected one of two detonation points with the chamber. Means are provided for directing shock waves, propagated from the first detonation point, against the surface in a first pattern of segment-defining lines and for directing shock waves, propagated from the second detonation point, against the surface in a second pattern of lines which define segments larger than those of the first pattern.

With reference now to FIG. 1, a preferred embodiment of the explosive structure includes an explosive warhead 10 of cylindrical configuration, the warhead having an outer casing structure 11 of substantially cylindrical configuration and having an inner surface 12 defining a chamber 13. The casing structure 11 may be of integral construction or, as in the present embodiment, may be comprised of a tubular body 14 having first and second end portions closed, respectively, by first and second, disc shaped, end pieces 15, 16 each disposed substantially perpendicularly of the tubular body 14. The end pieces 15, 16 are suitably threadingly connected to the end portions of the tubular body 14 upon internal threads formed within the respective end portions, as shown, or are otherwise rigidly affixed to the respective end portions. A layer of material 17 is mounted within the casing structure 11 adjacent at least a portion of the inner surface 12; in the present embodiment, the layer 17 is of tubular configuration and lines the inner surface of the tubular body 14. The layer of material 17, hereinafter termed the liner 17, is preferably of a material more compressible than the material of the outer casing structure 11 and is suitably formed of, for example, high density cork. More preferably, liner 17 comprises aluminum or an alloy comprising aluminum. The outer casing structure 11, or at least tubular body 14, is preferably formed of an energy dense explosive, which is discussed in greater detail herein, such as an energy dense material disclosed in commonly-owned, co-pending U.S. patent application Ser. No. 10/759,885, filed on 15 Jan. 2004, which is incorporated herein by reference in its entirety for all purposes. Means for propagating shock waves across the inner surface 12 and within the chamber 13 from a selected one of at least first and second locations, or detonation points, within the casing structure 11 are provided and, in the present embodiment, include an explosive charge 20, of a secondary high explosive as typically used in military warheads, substantially filling the cavity enclosed by the liner 17 and the end pieces 15, 16. The means for propagating shock waves further comprises first and second detonation charges 21, 22 suitably comprising first and second, conventional blasting caps respectively positioned coaxially of the first and second end pieces 15, 16 and extending through suitable bores formed through the respective end pieces 15, 16.

In the present, cylindrically configured embodiment, a first plurality of slots or grooves, termed, hereinafter, first grooves 25, are formed at least substantially through the liner 17 from its external surface. That is, the grooves 25 are cut substantially through, or, alternatively, completely through the liner 17. Preferably, the grooves 25 (as well as the second and third grooves 27, 29 to be described) are cut deeply enough to leave only a thin layer 18 (FIG. 3) of lining material on the inner side of the liner 17 for retaining the material of the explosive charge 17 in compacted, cylindrical configuration and thus preventing it from loosening, falling into the grooves 25, and becoming nonuniform. Alternatively, if the first grooves 25, and the second and third grooves 27, 29 (described below) are formed completely through the liner 17, in which case the liner comprises a plurality of segments of liner material, these segments are preferably bonded to an additional, inner tube (not shown) of a thin sheet of a material such as metal foil, cardboard, or plastic for ensuring proper spacing of the segments of lining material and for containing the material of the explosive charge 20.

Figure 2:
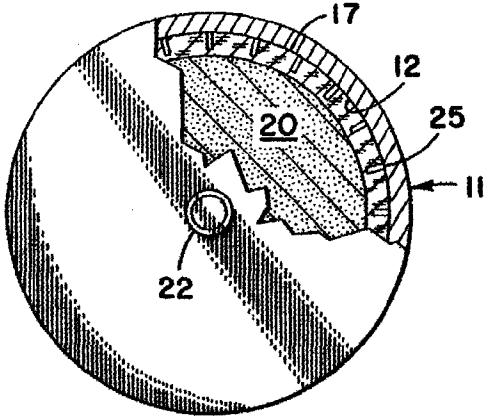
FIG. 2 is an end view, partially cut away, of the structure of FIG. 1.

The first grooves 25 extend, in approximately mutually parallel relationship, longitudinally of the casing structure 11 or such that each first groove 25 extends approximately in a respective plane coincident with an axis intersecting the first and second detonation charges 21, 22 (e.g., the central, longitudinal axis of the casing structure 11). With added reference to FIG. 2, the first grooves 25 are of greater depth than width and are cut approximately perpendicularly into the outer surface of the liner 17 and such that the sidewalls of each of the first grooves 25 are substantially radially oriented with respect to the axis bisecting the two detonation charges 21, 22. A second plurality of slots or grooves 27, termed second grooves 27, is similarly provided, the second grooves 27 being cut at least substantially through the liner 17 and also extending in approximately mutually parallel relationship. The second grooves 27 cross the first grooves 25 at approximately right angles and thus, in the present embodiment, extend circumferentially of the liner 17. The second grooves 27 are mutually spaced along the longitudinal axis of the casing structure 11 and, in cross section, are each inclined toward the first detonation charge 21. That is, in the present embodiment, each respective second groove 27 is inclined toward the first detonation charge 21 with respect to a plane intersecting the respective second groove 27 and extending perpendicularly of an axis which intersects both detonation charges 21, 22. Each second groove 27 is inclined from such a perpendicular plane by at least 10°, and preferably by about 20°. A third plurality of grooves or slots, termed third grooves 29, are also similarly cut at least substantially through the liner 17, the third grooves 29 also crossing the first grooves 25 at approximately right angles and extending circumferentially of the liner 17. These third grooves 29 are also mutually spaced along the length of the casing structure 11 but are spaced farther apart than the second grooves 27. The third grooves 29 are cut into the liner 17 as are the second grooves 27, but are inclined in an opposite direction, or toward the second detonating charge 22, for reasons which will become apparent. It will thus be seen that the second grooves 27 cross the first grooves 25 at approximately right angles to form a first pattern of segment-defining lines which define segments of approximately rectangular configuration. Similarly, the first grooves 25 cross the third grooves 29 to form a second pattern of segment-defining lines, but form segments of greater elongation and area than those of the first pattern, in that the third grooves 29 are spaced farther apart than the second grooves 27.

Figure 5:
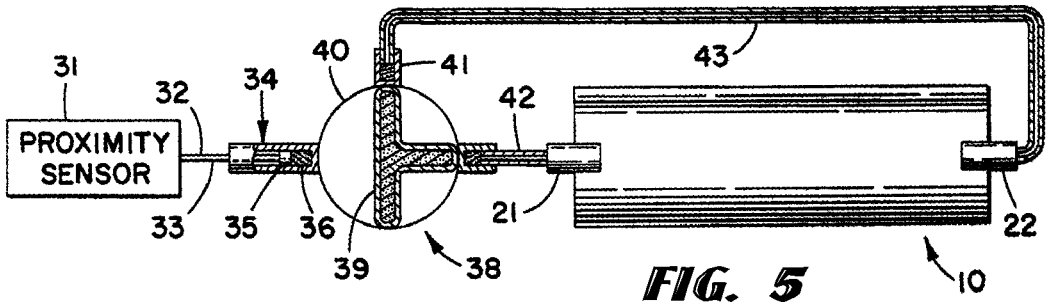
FIG. 5 is a diagrammatic representation of the structure of FIG. 1 and of apparatus, including an arming mechanism, for selectively detonating a respective one of the detonation charges.
Figure 6:
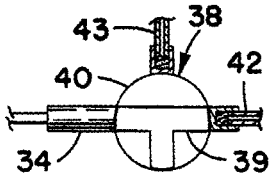
FIG. 6 is a diagrammatic representation of the arming mechanism of FIG. 5 in a first position.
Figure 7:
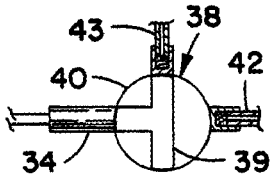
FIG. 7 is a view, similar to FIG. 6, showing the arming mechanism in a second position.

Various apparatuses may be employed for detonating a selected one, or both, of the detonating charges 21, 22, such as that disclosed in commonly-owned U.S. Pat. No. 4,745,864 to Craddock, which is incorporated herein by reference in its entirety for all purposes. With reference now to FIG. 5, apparatus for detonating a selected one, or both, of the detonating charges 21, 22 is diagrammatically shown with respect to application of the warhead 10 in a missile (not shown) adapted to detonate at a preselected distance from a target. A proximity sensing circuit 31 of the type adapted to emit an electrical signal upon reaching a predetermined distance from a target is connected, through first and second conductors 32, 33, to an electric detonator 34. The electric detonator 34 is of the well-known type employing a bridge wire (not shown) connected across the conductors 32, 33 and operable to ignite a primary explosive charge 35 positioned adjacent a secondary charge 36. Positioned adjacent the secondary charge 36 of the electric detonator 34 is an arming mechanism 38 of the general type commonly employed in explosive devices, known in the art as "safety and arming" mechanisms, and employing a rotatable member which is rotatable from a "safe" position to an "armed" position in which the explosive device may be detonated. In the present arming mechanism 38, an explosive lead 39 of T-shaped configuration is mounted upon a rotatable element, represented diagrammatically by the circle 40, and positioned between the electric detonator 34 and first and second detonating cords 42, 43 extending, respectively, to the first and second detonation charges 21, 22. The detonator 34, first detonation cord 42, and second detonation cord 43 extend radially toward the arming mechanism 38 from nine, three, and twelve o'clock directions respectively, as viewed in the drawing. Such detonating cords 42, 43 are commonly used in the art and employ a length of tubular material coaxially containing a length of rapidly detonating explosive. Such detonation cord is manufactured by E. I. du Pont de Nemours and Co. under the trade name "Primacord". In use, the detonating cord is normally terminated adjacent an additional, primary explosive charge 41 facing the arming mechanism 38 for ensuring ignition of the cord. The T-shaped explosive lead 39 of the arming mechanism 38 has its head and stem portions radially oriented on the rotatable member 40 and, in FIG. 5, is in a "safe" position in which the head portion of the "T" is positioned vertically, as viewed in the drawing, and is isolated from the electric detonator 34. With reference to FIG. 6, the rotatable member 40 has been rotated 90° from its safe position in a clockwise direction, as viewed, to a first, armed position in which the head portion of the T-shaped explosive lead 39 extends horizontally and is in register with the electric detonator 34 and the first detonation cord 42. A continuous explosive train now exists between the electric detonator 34 and the first detonation charge 21. Upon the rotatable member 40 being further rotated 90° in a clockwise direction to a second armed position, as shown in FIG. 7, a continuous explosive train extends to the second detonation charge 22. Finally, upon the rotatable member 40 being further rotated by 90° to a third armed position (FIG. 8), a continuous explosive train extends between the electric detonator 34 and both detonation charges 21, 22. The rotatable member 40 is positioned manually, prior to firing, in a selected one of the three armed positions. Alternatively, the positioning of the member 40 is remotely accomplished by means of a servomotor (not shown) drivingly connected to the member 40 and powered by a remotely actuated signal.

In operation, and with added reference to FIG. 1, fragmentation of the outer casing structure 11 is induced in a selected one of the first and second patterns by appropriately oriented detonation wave fronts expanding from the detonation charges 21, 22, as will now be described. Assume, for example, that it is desired to cause fragmentation of the casing 11 along the segment-defining lines of the first pattern, i.e., along the pattern formed by the first and second grooves 25, 27. The rotatable member 40 is positioned in its first position (FIG. 6) and a continuous explosive train is formed between the electric detonator 34 and the first detonation charge 21. In the above described, missile application, upon the warhead 10 reaching the predetermined distance from the target at which detonation is desired, the proximity sensing circuit 31 emits an electrical signal which is conducted by conductors 32 and 33 to the electric detonator 34 and causes sequential detonation of the detonator 34, the explosive lead 39, the first detonating cord 42, the first detonation charge 21, and the explosive charge 20. While the above-described arming mechanism 38 and proximity sensor 31 provide convenience of operation, alternate constructions are also satisfactory. For example, the explosive structure 10 may be employed as an impact detonation warhead 10 wherein a selected one of the detonation charges 21, 22 is oriented in a forward direction, upon firing, and is detonated upon its impact against a target, the charges 21, 22 (in such case) being impact-sensitive.

Detonation of the explosive charge 20 (FIG. 1) by the first detonating charge 21 produces a detonation shock wave which passes radially outwardly from the first detonation charge 21, through the explosive charge 20, and along the length of the casing structure 11 from the first detonation charge 21 to the second end piece 16. The rapidly expanding detonation shock wave thus passes across the liner 17 and the inner surface 12 of the casing structure 11. With added reference now to FIG. 3, an advancing, first detonation wave front propagated from the first detonation charge 21 is diagrammatically represented by the line 44 and rapidly moves in the direction represented by arrow 45. The representative, second groove 27 is inclined toward the first detonation charge 21 and thus, toward the advancing wave front 44. Thus, the wave front 44 is received and directed through the second grooves 27 toward the casing structure 11. The detonation wave front 44 is of an energy level such that it quickly penetrates any thin portion 18 of the liner 17 remaining across the grooves 25, 27, 29 and adjacent the explosive charge 20. Thus, the second grooves 27 are adapted to receive and direct the advancing detonation wave front 44 toward the outer casing structure 11; similarly, the first or longitudinal grooves 25 (FIGS. 1 and 2) receive and direct the wave front 44 toward the outer casing structure 11, because they are positioned in a radially oriented configuration, open to the advancing wave front 44, and through which the advancing wave front 44 may easily pass, the direction of movement of the wave front 44 being radially outward from the first detonation charge 21 and along the longitudinal axis of the casing structure 11. For reasons which are not completely understood, the grooves 25, 27, 29 of parallel sidewall construction apparently intensify the effect of the shock waves upon the surface 12 such that a definite deformation of the surface 12 is obtained.

Thus, the first detonation front 44 is directed through the first and second grooves 25, 27 toward and against the inner surface 12 of the tubular body portion 14 of the casing structure 11 in the first pattern of segment-defining lines defined by the first and second grooves 25, 27. The detonation front 44 also impinges upon the end pieces 15, 16. In the present embodiment, these end pieces 15, 16 are made of thicker material than the sidewalls of the tubular body 14, however, and are not readily deformed by the detonation of the explosive charge as is the tubular body 14.

Figure 3:
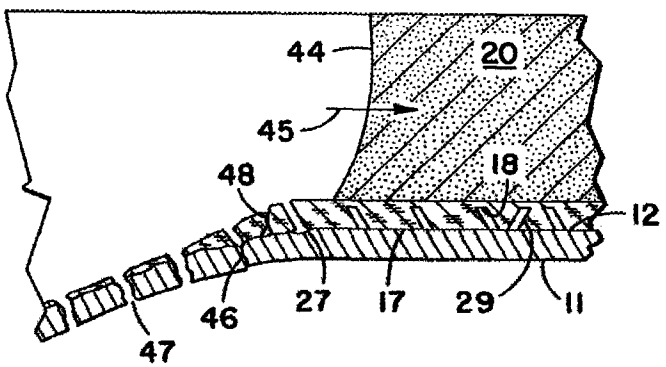
FIG. 3 is a longitudinal, sectional view of a portion of the fragmentation device of FIG. 1 showing the effects of a first detonation shock wave.

With reference to FIG. 3, the portions of the detonation shock wave 44 which are directed through the second grooves 27 and the first grooves 25 (FIGS. 1 and 2) impinge upon the respective, adjacent portions of the inner surface 12 with sufficient force to etch and deform the surface, forming corresponding grooves in the surface 12, and weakening the casing structure 11 along these grooves. A fraction of a second after the passing of the initial, detonation shock wave 44, gasses from the explosive charge 20 expand rapidly under every high pressure, which puts further stress upon the casing structure 11 and expands and separates the casing structure, as shown in FIG. 3. These expanding gasses also put further stress upon the grooved and weakened areas which have been cut along the first and second grooves 25, 27 by the detonation front 44, and these weakened areas act as stress risers to cause the casing structure 11 to crack, as shown at the fragmented portion 46 immediately to the left of the wave front 44, and ultimately, to separate under the force of the expanding gasses as shown at 47. The advancing detonation front 44 strikes the third grooves 29 in a direction athwart the sidewalls of the third grooves 29 rather than at an acute angle, and, because the grooves 29 are of substantially greater depth than width, the wave front 44 is not effectively channeled through the third grooves 29 toward the inner surface 12. Thus, substantially no weakening action is effected against the portions of the inner surface 12 of the casing 11 which are in register with the third grooves 29. In fact, in the present, preferred embodiment wherein the liner 17 is of a relatively compressible material, e.g., of cork, the advancing, detonation wave front 44 and the expanding detonation gasses tend to compress the liner 17, as shown by the compressed third groove 48, such that the expanding gasses are prevented from passing through the third grooves. The compressible liner 17 thus acts as a means for preventing fragmentation of the casing 11 in the second pattern or along the third grooves 29. Materials ordinarily considered relatively non-compressible, such as aluminum, iron, or plastics, can also be used, however.

Figure 4:
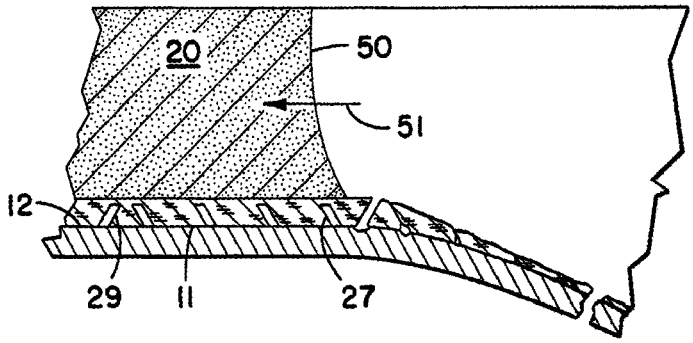
FIG. 4 is a view, similar to FIG. 3 showing the effects of a second detonation shock wave.
Figure 8:
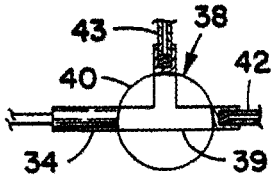
FIG. 8 is a view similar to FIGS. 6 and 7 and showing the arming mechanism in a third position.

Alternatively, if it is desired to fragment the casing structure 11 into larger fragments as defined by the second pattern (formed by the first and third grooves 25, 29), the explosive charge 20 is detonated by the second detonation charge 22 such that an oppositely directioned, second detonation shock wave 50 (FIG. 4) is produced with is propagated radially outwardly from the second detonation charge 22 (FIG. 1) and thus passes from the second charge 22 toward the first end portion 15, or from right to left as viewed in the drawing and as shown by arrow 51. The second detonation shock wave 50 is directioned through the first and third grooves 25, 29 but is largely prevented from passing through the second grooves 27, according to the same principal described above with respect to the first shock wave 44 of FIG. 3; and thus, the casing structure 11 is fragmented along the second pattern of lines such that elongated fragments of a larger area are produced. Accordingly, the first and second grooves 25, 27 comprise a first means for directing shock waves, propagated from the first detonation charge 21, against at least a selected portion (i.e., the portion covered by the liner 17) of the inner surface 12 in a first pattern of segment-defining lines for scoring and weakening the casing along the first segment-defining lines, and the first and third grooves 25, 29 comprise a means for directing shock waves, propagated from the second detonation charge 22, against the selected inner portion of the inner surface 12 in a second pattern of segment-defining lines which are larger than the segments of the first pattern. Alternatively, the grooved liner 17 is extended over the end portions 15, 16 to cause fragmentation of these portions also if desired. However, complete selectivity of operation may not be practicable with respect to the end pieces 15, 16. For example, a detonation shock wave propagated from the second detonation charge 23 impinges upon the first end piece 15 substantially perpendicularly and penetrates all grooves formed in lining material covering the first end piece 15. If it is desired to fragment the casing structure 11 into a combination of large and small fragments, the rotatable member 40 of the arming mechanism 38 (FIG. 5) is initially positioned in its third armed position as shown in FIG. 8, whereupon both detonation charges 21, 22 are detonated upon activation of the fuze 34. By constructing the first and second detonation cords 42, 43 of equal lengths, substantially simultaneous detonation of the charges 21, 22 is obtained, and a combination of large and small fragments is produced. Moreover, it will be apparent that various combinations of large and small fragments can be obtained by varying the relative lengths of the first and second detonation cords 42, 43.

It can thus be seen that the described structure provides a means for selectively producing either large or small fragments from a single warhead, yet remains of relatively simple and practicable construction, requiring no complex machining of metal parts. The larger, elongated fragments produced by detonation of the second detonation charge 22 are effective where greater penetrating power is desired, in that at least some of these fragments will be driven against the target in a substantially axial direction, or as an impinging arrow, such that greater kinetic energy per unit area is expended against the target. The elongated fragments are thus adapted for effective use against armored vehicles or emplacements.

Figure 9:
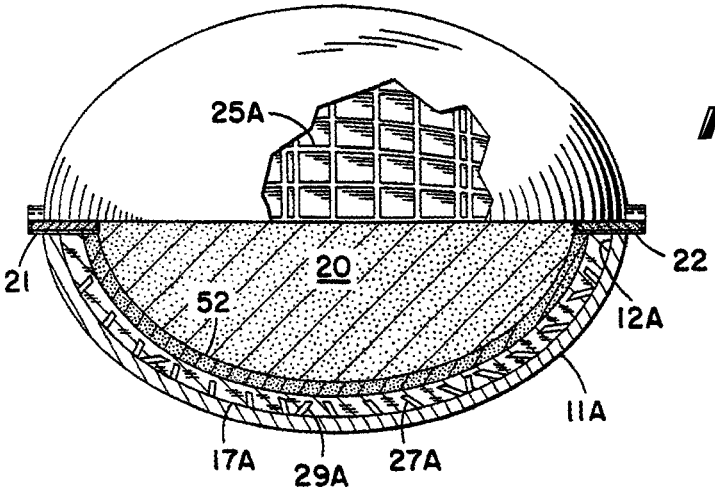
FIG. 9 is a view, similar to FIG. 1, of a warhead illustrative of a second embodiment of the invention.

While the explosive structure has thus far been described with reference to a warhead 10 having a substantially cylindrical configuration, further embodiments are possible utilizing the inventive concept, provided that the grooves of the first pattern include some grooves which are open to and adapted to receive detonation shock waves propagated from a first detonation charge only, and that the grooves of the second, segment-defining pattern include some grooves which are adapted to receive detonation shock waves propagated from the second detonation charge but which are not responsive to those from the first detonation charge. For example, and as shown in FIG. 9, a casing structure 11A of ellipsoidal configuration may be employed, also utilizing first and second detonation charges 21, 22 mounted in opposite end portions of the casing structure. First, longitudinal grooves 25A extend lengthwise of the casing structure 11A, i.e., the first grooves 25A are intersected by respective planes which are coincident with a central axis intersecting both the first and second detonation charges 21, 22 respectively, as in the cylindrical structure described above. Second and third grooves 27A, 29A are cut circumferentially into the liner 17A in a similar fashion to that described with respect to those of the first, cylindrical embodiment, and are respectively sloped, in cross section, toward the first and second detonation charges 21, 22 with respect to the inner surface 12A of the casing structure 11A. That is, with respect to a respective plane extending tangentially of the inner surface 12A at its intersection with a respective one of the second grooves 27A, the respective second groove 27A is inclined, from perpendicular to the tangential plane, toward the first detonation charge 21, and any respective third groove 29A is oppositely sloped, with respect to a corresponding, respective, tangential plane, toward the second detonation charge 22. The above-described, ellipsoidal configuration may be detonated as was described with respect to the cylindrical embodiment, or a further means for propagating the initial shock waves may be provided by the use of a detonation layer 52 formed of a sheet of explosive having a detonation velocity substantially greater than that of the main detonation charge 20. The detonation layer 52 is mounted within the casing structure 11A and liner 17A, adjacent the inner surface of the liner 17A and between the liner and the explosive charge 20. Upon detonation of the first detonation charge 21, for example, detonation of the layer 52 is initiated at its portion most closely adjacent the first detonation charge, and a detonation shock wave propagates through the detonation layer 52 outwardly from the first detonation charge 21. This detonation shock wave is received by and conducted through the first and second grooves 25A, 27A in the same manner as was the first detonation wave 44 (FIG. 3) of the cylindrical embodiment because the first and second grooves 25A, 27A are directioned toward the advancing shock wave. The first and second grooves 25A, 27A direct the shock wave against the inner surface 12A in a first pattern of segment-defining lines, scoring and weakening the casing structure 11A along these lines as in the first embodiment. Detonation of the main explosive charge 20 is also initiated by the first detonation charge 21, and the main explosive 20 then acts to fragment the casing along the first pattern of segment-defining lines produced by the detonation shock wave initially propagated by the detonation layer 52.

Preferably, outer casing structure 11, or at least tubular body 14, comprises a class of materials that have the characteristic of rapidly liberating thermal and mechanical energy upon initiation of a chemical reaction. The materials are constructed from mixtures of or alternating layers of a reactive metal (preferably in hydride form or with interstitial hydrogen) and a metal oxide such that a thermodynamically favored redox reaction can occur. In a preferred embodiment, the reactive material mixtures are close to a stoichiometric oxygen balance.

The preferred material for outer casing structure 11, or at least tubular body 14, liberates thermal energy through an oxygen rearrangement reaction between a reactive metal and a metal oxide. One example is the thermite reaction: $Fe_2O_3+2Al \rightarrow 2Fe+Al_2O_3$.

The reaction velocity of the reactive fragments will control the damage radius of the fragmentation pattern. The faster the fragments burn, the smaller the damage radius. The reaction velocity of reactive materials is controlled by manipulating the spacing between the fuel and the oxidizer reaction constituents. The reaction will proceed faster if the spacing is smaller. The fastest reaction rates occur with particle or layer thicknesses on the order of tens of nanometers. Preferred thickness is dependent upon desired reaction rate and the specific reactants.

Figure 10:
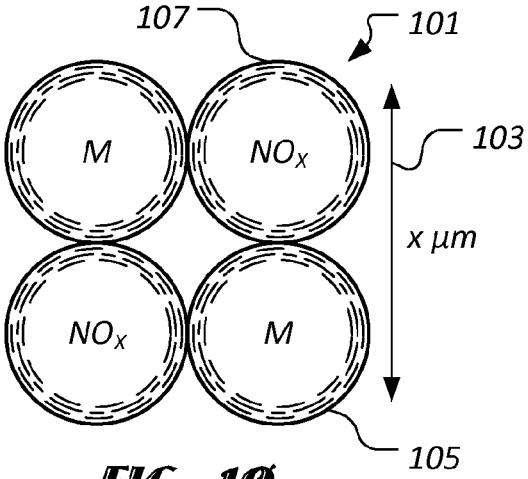
FIG. 10 (PRIOR ART)
FIG. 10 is a schematic diagram of a structure of a prior art energy dense explosive material.

Referring to FIG. 10, prior art energy dense explosive 101 comprises an array 103 of alternating metal 105 and metal oxide 107, with layers being microns or greater In thickness. The preferred energy dense explosive for outer casing structure 11, or at least tubular body 14, provides a different pattern that reduces diffusion flux, given by the equation $J=(1/A)\,dm/dt$, where J is diffusion flux, m is mass. A is unit cross sectional area, and t is time.

Figure 11:
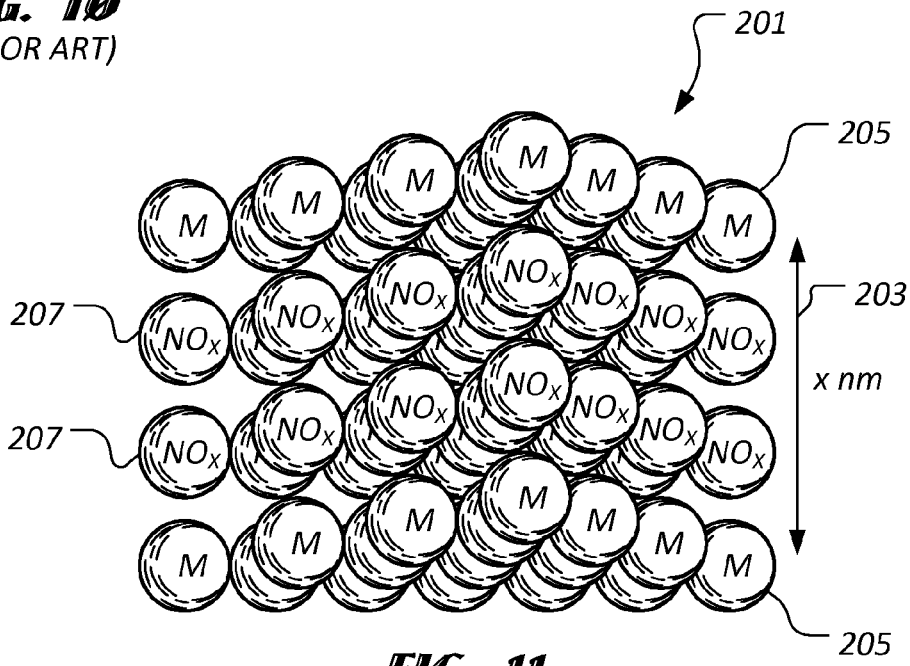
FIG. 11 is a schematic diagram of an illustrative structure of an energy dense explosive material suitable for an explosive, fragmentation structure of the present invention.

Referring to FIG. 11, the energy dense explosive 201 of the present invention comprises alternating layers 203 of metal 205 and metal oxide 20, with layers 203 and/or 205 being no more than about 1 micron in thickness, preferably no more than about 100 nm in thickness, and most preferably no more than about 10 nm in thickness. The alternation is preferably, from bottom to top, metal layer, metal oxide layer, metal oxide layer, metal layer, repeated as necessary, but other alternatives are possible.

Figure 12:
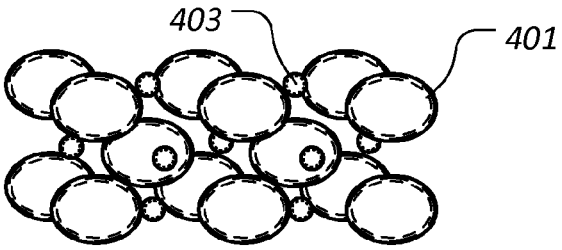
FIG. 12 is a schematic diagram of a use of metal hydrides and/or hydrogen interstitials in the energy dense explosive material of FIG. 11.

Preferably, a metal hydride or solid solution interstitial hydrogen is one of the reactants in the preferred energy dense explosive. Upon initiation of the thermite reaction, for example, the hydrogen will be released as a hot gas. FIG. 12 shows a metal layer of FIG. 2 modified to incorporate this solution, with metal atoms 401 and hydrogen atoms 403. This provides for efficient packing of reactants.

It should be noted that the fragments of outer casing structure 11, or at least tubular body 14, resulting from detonation of warhead 10, are reactive. These reactive fragments may be explosive and/or incendiary, with or without a tunable initiation. The following reaction is an example: $4AlH_x+3MnO_2 \rightarrow 2Al_2O_3+3Mn+xH_2O$.

When the warhead 10 is initiated from a first end, for example, large energetic fragments are produced that begin reacting upon initial acceleration. After a finite time/distance, the fragments will be consumed, rendering them nonexistent. Conversely, initiating a second end of the warhead 10 results in smaller fragments that, consequently, react more quickly, yielding a smaller radius of effect. It should be noted that if the explosive charge 20 is initiated in a deflagration mode, rather than in a detonation mode, some or all of the energetic fragments will not initiate, thus providing large or small fragments having the same effect as conventional, fragmentation devices.

It should also be noted that the burn rate of the preferred energy dense explosive material can be tailored, for example, within a range of less than 1 m/sec to over 100 m/sec. The energy dense explosive material is tailored by selecting different fuel/oxidizer pairs and varying the size of the particles and/or layers. For example, thicker layers and/or larger particles produce a slower burn rate than thinner layers and/or smaller particles.

Thus, in either configuration, an explosive warhead structure of the fragmentation type is taught which provides selectivity with respect to fragment size, thus providing the advantage of effectiveness against a wide variety of targets while avoiding the necessity of supplying and transporting fragmentation structures of different constructions appropriate for differing targets. Moreover, because the fragments comprise an energy dense explosive, the radius of effects of the structure is controlled. Substantially all of the casing structure is fragmented into fragments of selected size, as contrasted to prior, compromised designs in which, for example, half the structure fragments into relatively small fragments and half into larger fragments. A further advantage is that the liner 17, if made of a compressible material as described, insulates the explosive charge 20 against accidental detonation by either heat or mechanical shock to the casing. The fragmentation structure also provides the well-known advantages obtained by the use of a non-scored casing structure, i.e., the casing structure is not weakened, during its manufacture, by scoring, and the expense of machining or otherwise forming grooves in a metal casing structure is avoided. Moreover, in addition to providing the above-cited advantages, the fragmentation structure is also of practicable and economical construction.

The present invention provides significant advantages, including: (1) effectiveness against a wide variety of targets while avoiding the necessity of supplying and transporting fragmentation structures of different constructions appropriate for differing targets; and (2) controlling the radius of effects of the initiated structure.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An explosive structure of the fragmentation type, comprising:

an outer casing comprising an energy dense explosive material and having an inner surface defining a chamber;

means for propagating shock waves across the inner surface from a selected one of at least first and second detonation points within the casing;

first means for directing shock waves, propagated from the first detonation point, against at least a selected portion of the inner surface in a first pattern for scoring and weakening the casing along first, segment-defining lines;

second means for directing shock waves, propagated from the second detonation point, against the selected portion of the inner surface in a second pattern for scoring and weakening the casing along second, segment-defining lines, the segments of the second pattern being larger than the segments of the first pattern; and means for fragmenting the casing along the resulting, segment-defining lines scored in the casing.

2. The structure of claim 1, wherein the energy dense explosive material comprises:

a layer of material comprising one or more metals substantially not in oxide form; and a layer of material comprising one or more metal substantially in oxide form;

wherein the layers in combination are energetic and exhibit a thickness of no more than about 100 nanometers.

3. The structure of claim 2, wherein the layers exhibit a thickness of no more than about 10 nm.

4. The structure of claim 2, comprising:

a plurality of layers of material comprising one or more metals substantially not in oxide form.

5. The structure of claim 4, comprising:

a plurality of layers of material comprising one or more metals substantially in oxide form.

6. The structure of claim 5, wherein each layer of material comprises:

one or more metals substantially in oxide form adjacent to at least one layer of material comprising one or more metals substantially not in oxide form.

7. The structure of claim 2, comprising:

a plurality of layers of material comprising one or more metals substantially in oxide form.

8. The structure of claim 2, wherein the energy dense explosive material comprises:

a first layer of material comprising one or more compositions selected from the group consisting of metal hydrides and metals with interstitial hydrogen; and a second layer of material, comprising one or more metals substantially in oxide form;

wherein the layers in combination are energetic and exhibit a thickness of no more than about 100 nanometers.

9. The structure of claim 8, wherein the first layer of material comprises:

one or more metal hydrides.

10. The structure of claim 8, wherein the first layer of material comprises:

one or more metals with interstitial hydrogen.

11. The structure of claim 1, wherein the means for fragmenting the casing comprises an explosive charge contained within the outer casing and wherein the means for propagating shock waves across the inner surface comprises at least two detonating charges respectively positioned within the casing at the first and second detonation points.

12. The structure of claim 11, wherein:

the first and second directing means include a layer of material lining at least the selected portion of the inner surface of the outer casing and enclosing the explosive charge;

the first directing means comprises grooves formed in the layer of material and opening at least toward the outer casing, at least some of the grooves of the first directing means being inclined, in cross section and with respect to the adjacent inner surface of the casing, toward the first detonation point for passing detonation shock waves, propagated from the first detonation point, to the outer casing; and the second directing means comprises grooves formed in the layer of material and opening at least toward the outer casing, at least some of the grooves of the second directing means being inclined, in cross section and with respect to the adjacent inner surface of the casing, toward the second detonation point for passing detonation shock waves, propagated from the second detonation point, to the outer casing.

13. An explosive structure of the fragmentation type, comprising:

an outer casing comprising an energy dense explosive material and having an inner surface defining a chamber;

at least two detonating charges respectively positioned within the casing at the first and second detonation points for propagating shock waves across the inner surface from a selected one of at least first and second detonation points within the casing;

a layer of material lining at least a selected portion of the inner surface of the outer casing and enclosing the explosive charge, the layer defining:

a first set of grooves formed in the layer of material and opening at least toward the outer casing, at least some of the first set of grooves being inclined, in cross section and with respect to the adjacent inner surface of the casing, toward the first detonation point for passing detonation shock waves, propagated from the first detonation point, to at least the selected portion of the inner surface of the outer casing in a first pattern for scoring and weakening the casing along first, segment-defining lines; and a second set of grooves formed in the layer of material and opening at least toward the outer casing, at least some of the second set of grooves being inclined, in cross section and with respect to the adjacent inner surface of the casing, toward the second detonation point for passing detonation shock waves, propagated from the second detonation point, to at least the selected portion of the inner surface of the outer casing in a second pattern for scoring and weakening the casing along second, segment-defining lines; and an explosive charge contained within the outer casing for fragmenting the casing along the resulting, segment-defining lines scored in the casing.

14. The structure of claim 13, wherein the segments of the second pattern are larger than the segments of the first pattern.

15. The structure of claim 13, wherein the energy dense explosive material comprises:

a layer of material comprising one or more metals substantially not in oxide form; and a layer of material comprising one or more metal substantially in oxide form;

wherein the layers in combination are energetic and exhibit a thickness of no more than about 100 nanometers.

16. The structure of claim 15, wherein the layers exhibit a thickness of no more than about 10 nm.

17. The structure of claim 15, comprising:

a plurality of layers of material comprising one or more metals substantially not in oxide form.

18. The structure of claim 17, comprising:

a plurality of layers of material comprising one or more metals substantially in oxide form.

19. The structure of claim 18, wherein each layer of material comprises:

one or more metals substantially in oxide form adjacent to at least one layer of material comprising one or more metals substantially not in oxide form.

20. The structure of claim 15, comprising:

a plurality of layers of material comprising one or more metals substantially in oxide form.

21. The structure of claim 15, wherein the energy dense explosive material comprises:

a first layer of material comprising one or more compositions selected from the group consisting of metal hydrides and metals with interstitial hydrogen; and a second layer of material, comprising one or more metals substantially in oxide form;

wherein the layers in combination are energetic and exhibit a thickness of no more than about 100 nanometers.

22. The structure of claim 21, wherein the first layer of material comprises:

one or more metal hydrides.

23. The structure of claim 21, wherein the first layer of material comprises:

one or more metals with interstitial hydrogen.

* * * * *